United States Patent [19]

Ishihara

[11] 3,947,211

[45] Mar. 30, 1976

[54] SUPPORT MEANS FOR AN ELONGATED POURING PIPE

[76] Inventor: Yasushi Ishihara, No. 16-I, I-Chome, Takeoka, Kiyose, Tokyo, Japan

[22] Filed: Aug. 20, 1973

[21] Appl. No.: 389,803

[52] U.S. Cl. ..... 425/447; 264/311

[51] Int. Cl.[2] ..... B28B 13/02

[58] Field of Search ..... 425/262, 425–427, 425/435, 117, 123, 447; 249/88, 91; 264/278, 311

[56] References Cited

UNITED STATES PATENTS

| | | | |
|---|---|---|---|
| 1,199,997 | 10/1916 | Lienesch | 425/262 |
| 1,521,264 | 12/1924 | Zehnder | 425/426 |
| 1,752,626 | 4/1930 | Zehnder | 425/426 |
| 1,785,586 | 12/1930 | Hume | 425/435 |
| 1,918,333 | 7/1933 | Hallquist | 249/91 |
| 2,566,689 | 9/1951 | Whiting | 425/117 |
| 3,161,704 | 12/1964 | LeGrand et al. | 425/110 |
| 3,345,716 | 10/1967 | Uden | 425/117 |
| 3,381,744 | 5/1968 | Tallone | 425/425 |

FOREIGN PATENTS OR APPLICATIONS

| | | | |
|---|---|---|---|
| 460,388 | 11/1950 | Italy | 425/117 |
| 835,240 | 3/1952 | Germany | 264/278 |

*Primary Examiner*—Francis S. Husar
*Assistant Examiner*—John McQuade
*Attorney, Agent, or Firm*—Spensley, Horn and Lubitz

[57] ABSTRACT

An improved means for supporting an elongated device for pouring concrete pipe, pile and similar devices. The means makes use of pins movably supporting a device for pouring concrete inside of a concrete molding frame and support levers support the concrete pouring device outside of the frame in order to prevent the concrete pouring pipe from being flexed with its own weight.

6 Claims, 3 Drawing Figures

SUPPORT MEANS FOR AN ELONGATED POURING PIPE

BACKGROUND OF THE INVENTION

This invention relates to a means for supporting a concrete pouring device such as a pouring pipe suited for molding a long concrete member such as a pipe.

Operation of pouring and placing concrete into a steel molding frame in a process of manufacturing long concrete pipes, piles and other members, utilizing centrifugal force has usually been one of the most timeconsuming and laborious tasks. There has already been proposed and practically employed a method of concrete pouring wherein the concrete is placed into a molding frame utilizing a concrete pump to save labor. This method of the prior art utilizing the concrete pump comprises the steps of placing support means for a concrete pouring pipe in the form of a cantilever member in front of the outlet of said concrete pump and introducing the front end of said pouring pipe supported by said support means into a hollow interior of a cylindrical molding frame of steel carried on a flatcar by moving said flatcar in parallel with axes of said concrete pouring pipe. This method of prior art has been disadvantageous, however, in that said cantilever-shaped support means should be necessarily of a large scale, since the concrete pouring pipe is supported merely by said support means in the form of a cantilever member and the part of said pipe which is in the hollow interior of said cylindrical molding frame of steel is held without any support. This means that the length of said part which can be introduced into the molding frame is disadvantageously limited. Therefore, what is needed then is a means by which extraordinary lengths of concrete pipe and pile may be centrifugally molded without entailing an undue amount of time or hand labor.

SUMMARY OF THE INVENTION

The principal object of this invention is to provide support means suited for molding a long concrete pipe or similar member, which may be simply constructed and therefore easily manufactured.

Other and further objects of this invention will become obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

In the drawings, a process of manufacturing a long concrete pipe or similar member according to the present invention is shown by way of example in which.

DETAILED DESCRIPTION

Figure 1:
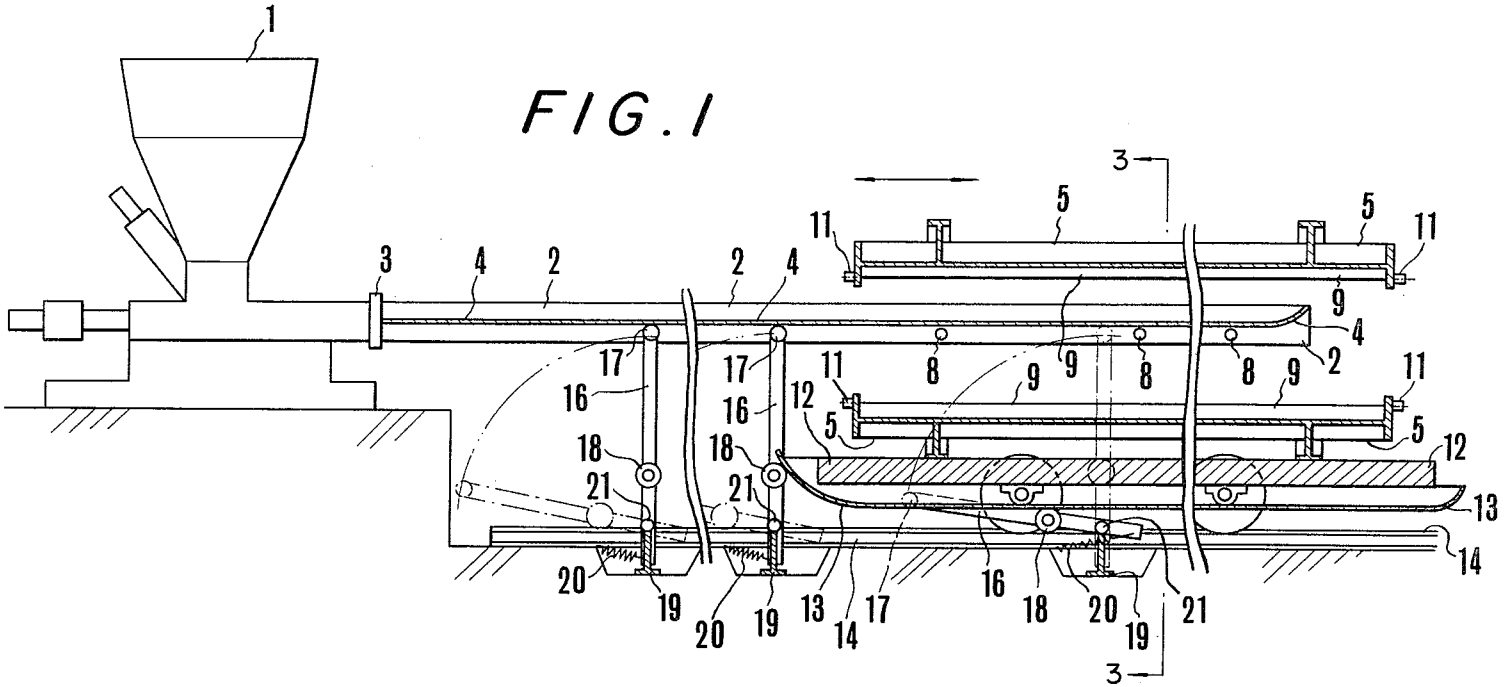
FIG. 1 is a side view in which the molding frame is shown in section.

The present invention will be now described, by way of example, as in the production of long cylindrical pipes, with reference to the accompanying drawings. It is understood that this invention may be employed to form any elongated concrete member.

A concrete pouring pipe 2 with bearing flanges 4 axially extending integrally therewith on both sides is connected by a water tight joint 3 to the outlet of a concrete pump 1 and horizontally supported by a suitable number of retractable support levers 16 for the concrete pouring pipe which support levers 16 are vertically fixed by stands 19 to a floor and which rotatably engage flanges 4 by means of rollers 17. Support levers 16 are pivoted to stand 19 by a pivot means 21. Coil springs 20 are coupled to support levers 16 and encourage levers 16 into a generally upright position. The stands 19 are, in turn, positioned at such intervals so that flexing of said concrete pouring pipe may be reduced to a minimum in spite of the weight of concrete pumped therethrough. A suitable number of horizontal support rods or support pins 7 are provided at such intervals that the concrete pouring pipe 2 introduced into the hollow interior of a molding frame 5 may be supported by these support pins 7 without occurrence of a substantial flexing of said concrete pouring pipe 2. It should be noted here that said support pins 7 extend through respective sockets 6 (FIG. 3) which sockets 6 are fixed by appropriate means, such as welding on both sides of said molding frame 5. Then the assembled molding frame 5 is held by support blocks 15 on a flatcar 12 at a predetermined position and said flatcar 12 is moved on rails 14 toward the concrete pump so that an end of the pouring pipe 2 may be introduced into the hollow interior of the molding frame 5. Simultaneously, a skid 13 mounted on base of the flatcar 12 may be urged against a roller 18 mounted between each pair of support levers 16 at middle points thereof. Thus said support levers 16 are successively moved downward from a position where they support the concrete pouring pipe 2 to a position at which these support levers 16 lie under the skid 13 allowing the flatcar 12 to move further toward concrete pump 1. The end of said concrete pouring pipe 2 thus introduced into the hollow interior of the molding frame 5 now has its bearing flange 4 smoothly moving and supported on rollers 8 mounted at the ends of the support pins 7 projecting into said molding frame 5. The bearing flanges 4 are integrally formed on both sides of said concrete pouring pipe 2. When the end of the concrete pouring pipe 2 reaches a point adjacent the opposite end of the molding frame 5, the flatcar 12 is moved in the opposite direction relative to the concrete pump as concrete is poured and placed through said pouring pipe into the hollow interior of said molding frame 5 until the process of pouring and placing of the concrete is completed. The support levers 16 for the concrete pouring pipe 2 automatically restore their vertical positions under effect of coil springs 20 as the flatcar 12 is moved in the direction away from concrete pump 1 on rails 14 and again support the concrete pouring pipe 2. After completion of the pouring of the concrete, the support pins 7 are removed through the sockets 6 before the wet concrete hardens, said sockets 6 being filled with plug bolts (not shown) to prevent the wet concrete from flowing out therethrough.

Figure 3:
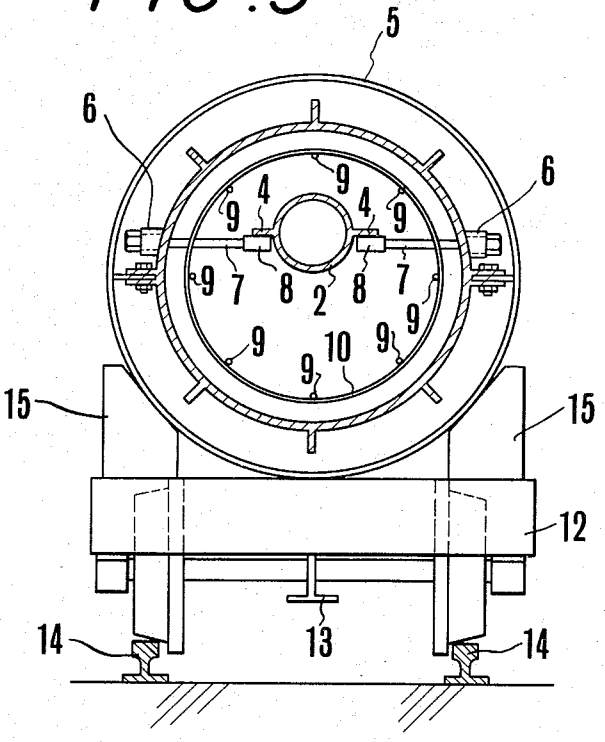
FIG. 3 is a front view in section taken along a line 3—3 in FIG. 1.
Figure 2:
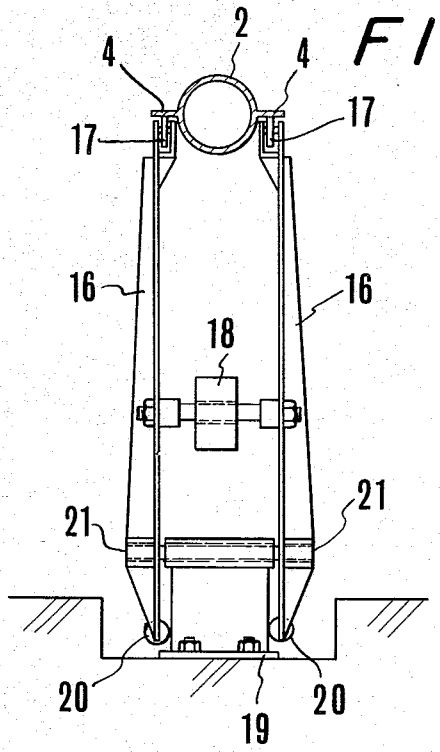
FIG. 2 shows in enlarged scale a pair of support levers for supporting the concrete pouring pipe.

As shown in FIGS. 1 and 3 and as is well known to the art, the cast concrete may be reinforced by an internal network of steel. By way of example, steel rods 9 and 10 are shown as assembled within molding frame 5 before the placement of concrete therein by means of the present invention. Rods 9 are illustrated as longitudinal rods extending axially down the length of molding frame 5, while rods 10 are shown as circumferential, circular bracing connected to rods 9. Thus rods 9 and 10 in combination form a cylindrical steel cage which is well known to the art as reinforcement for cylindrical concrete sections. The cylindrical cage 9, 10 is fixed and centered within molding frame 5 by means of sockets 11 provided in end plates which may be attached to the ends of molding frame 5. Rods 9 extend through sockets 11 provided in end plates as shown in FIG. 1. In practice, since the length of molded pipe or pile may approach or exceed 40 meters, cage 9, 10 may be given additional support and centering along its length by means of spacers, well known to the art, which are usually of concrete and which remain embedded in the finished molding.

Wet concrete deposited within molding frame 5 will generally collect at the bottom portion of molding frame 5. After a sufficient amount of concrete has been deposited within molding frame 5, by pouring pipe 2, which has been removed from molding frame according to the present invention, and after support pins 7 and rollers 8 have been removed through sockets 6 as described above, the concrete may be distributed and compacted about the interior of molding frame 5 by means of centrifugal force as is well known to the prior art.

It will be understood from the aforegoing description that, according to the present invention, a concrete pouring pipe 2 of a relatively thin thickness, such as a gas pipe which is commercially available, may be horizontally supported on the support means which is the subject of the present invention so long as said thickness is sufficient to resist the pressure of the concrete flowing through the pipe. This support means, fabricated according to the present invention, may substantially facilitate production of cylindrical concrete pipe, pile and the like of a length or a diameter that is too large or small, respectively, to be obtained by the methods pouring concrete pipe which are conventionally employed.

I claim:

1. An apparatus for forming a concrete structural member comprising:

an elongated molding frame;

an elongated pouring pipe adapted for pouring a concrete mixture therethrough, said pouring pipe longitudinally positionable within said molding frame;

a plurality of support pins extending through said elongated molding frame and removable therefrom, said support pins in slideable contact with said pouring pipe when said pouring pipe is disposed within said elongated molding frame; and a plurality of support levers to provide support for said pouring pipe when said pouring pipe is withdrawn from contact with said support pins within said elongated molding frame, said support levers being normally biassed into supporting engagement with said pipe and also being retractable from engagement with said pipe upon engagement by means associated with said molding frame.

2. The apparatus of claim 1 further comprising:

a spring means coupled to each of said support levers, for biassing said support levers into the upright position thereby supporting said pouring pipe.

3. The apparatus of claim 2 further comprising:

a movable means for supporting said elongated molding frame, said movable means to translate said elongated molding frame thereby disposing said pouring pipe within said elongated molding frame, said movable means sequentially engaging each of said of retractable support levers encouraging each of said support levers to retract from the upright position to a position permitting sequential engagement with another one of said support levers.

4. The apparatus of claim 3 wherein each of said support levers further comprises:

two rigid members one end of each member in slideable contact with said pouring pipe, the correspondingly opposite end of each member coupled to said spring means;

a pivot means coupled to each of said rigid members, said pivot means for permitting said rigid members to retract to a position permitting said movable means to sequentially engage each of said support levers; and a second roller coupled to said rigid members to provide for rotatable engagement with said movable means.

5. The apparatus of claim 1 wherein said elongated molding frame has a generally circular cross-section, and said plurality of support pins are disposed on a diameter of said elongated molding frame, and further comprising:

a plurality of sockets disposed on said diameter of said molding frame, each of said support pins removably extending through one of said sockets and through said elongated molding frame, said socket to provide additional support for said corresponding support pin.

6. The apparatus of claim 5 further comprising:

a first roller disposed on an end of each said support pins, said first roller being in slideable contact with said pouring pipe.

* * * * *